United States Patent [19]

Haupt

[11] 4,225,296

[45] Sep. 30, 1980

[54] GEAR PUMP WITH TRANSMISSION GEARWHEEL ADJUSTMENT

[75] Inventor: Fritz Haupt, Regensdorf, Switzerland

[73] Assignee: Maag Gear Wheel & Machine Company, Zurich, Switzerland

[21] Appl. No.: 924,668

[22] Filed: Jul. 14, 1978

Related U.S. Application Data

[63] Continuation of Ser. No. 744,782, Nov. 24, 1976, abandoned.

[30] Foreign Application Priority Data

Dec. 11, 1975 [CH] Switzerland ..... 16092/75

[51] Int. Cl.[3] ..... F04C 1/08; F04C 15/00; F16H 35/08

[52] U.S. Cl. ..... 418/206; 74/401

[58] Field of Search ..... 418/191, 201, 205, 206, 418/270; 29/156, 4 R, 427, 446; 74/401-403, 409

[56] References Cited

U.S. PATENT DOCUMENTS

| | | | |
|---|---|---|---|
| 2,559,590 | 7/1951 | Brown | 418/206 |
| 2,640,428 | 6/1953 | Houghton | 74/409 |
| 2,671,949 | 3/1954 | Welton | 29/446 |
| 2,708,548 | 10/1955 | Blanton | 418/206 |
| 2,817,142 | 12/1957 | Boden et al. | 29/427 |
| 2,840,399 | 6/1958 | Harless et al. | 29/446 |
| 2,926,940 | 3/1960 | Maass | 29/446 |
| 2,992,479 | 7/1961 | Musser et al. | 29/446 |
| 3,278,193 | 10/1966 | Groner et al. | 29/446 |
| 3,281,063 | 10/1966 | Allen | 418/206 |

*Primary Examiner*—John J. Vrablik

*Attorney, Agent, or Firm*—Toren, McGeady and Stanger

[57] ABSTRACT

A gear pump of the kind in which auxiliary gearing is relied upon to produce synchronized movement between intermeshed pumping gears includes one gearwheel of the auxiliary gearing mounted on a shaft means are provided for supplying hydraulic fluid under pressure to an interface between the gearwheel and the shaft so as to allow the gearwheel to be expanded hydraulically in order to effect relative angular adjustment between the gearwheel and the shaft for locating the pumping gears at their required relative angular positions.

4 Claims, 2 Drawing Figures

GEAR PUMP WITH TRANSMISSION GEARWHEEL ADJUSTMENT

This is a continuation of application Ser. No. 744,782 filed on Nov. 24, 1976, now abandoned.

BACKGROUND OF THE INVENTION

The invention relates to a gear pump with auxiliary gearing, in which the liquid-conveying pumping gears do not permit synchronous movement transmission and the auxiliary gearing ensures positive drive of the liquid-conveying pumping gears. In these gear pumps the rotational adjustment of the gears of the auxiliary gearing in relation to the liquid-conveying pumping gears must be very accurately made in order to enable the desired functioning of the latter to be fully ensured and to prevent incorrect contact between the tooth flanks of the two gears, that is to say, to permit a predetermined flank clearance (as described for example in U.S. Pat. No. 3,640,650).

Hitherto this rotational adjustment could be made only at considerable expense.

One possible way lies in providing the auxiliary gearing with helical teeth and making one gear adjustable for axial movement in a keyway. By means of the axial displacement the rotary adjustment of the two auxiliary gears in relation to one another can be controlled.

In another procedure the keyway of one auxiliary gear is produced subsequently, or with the aid of special manufacturing devices, in accordance with the correct engagement of the two liquid-conveying pumping gears, in which case the keyway must be correctly positioned with great accuracy.

SUMMARY OF THE INVENTION

A far simpler solution is now provided according to the present invention, wherein for the purpose of rotational adjustments on the shaft one gear of the auxiliary gearing is arranged to be elastically expanded with the aid of a hydraulic medium.

Hydraulic expansion for the making and dismantling of press-fitted connections between shafts and elements mounted thereon is known per se. However, it has not hitherto been realised that this could be used with great advantage for rotational adjustment in gear pumps having auxiliary gearing, and not solely for the detachment of press-fitted connections per se.

DESCRIPTION OF THE PREFERRED EMBODIMENT

Figure 1:
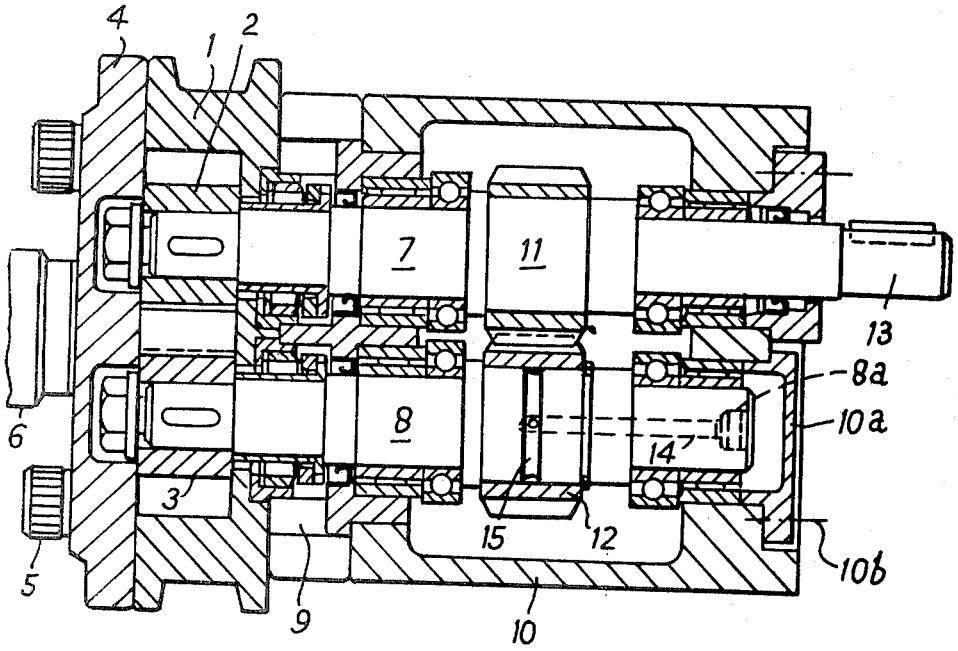
FIG. 1 is a horizontal section through a gear pump according to the invention.
Figure 2:
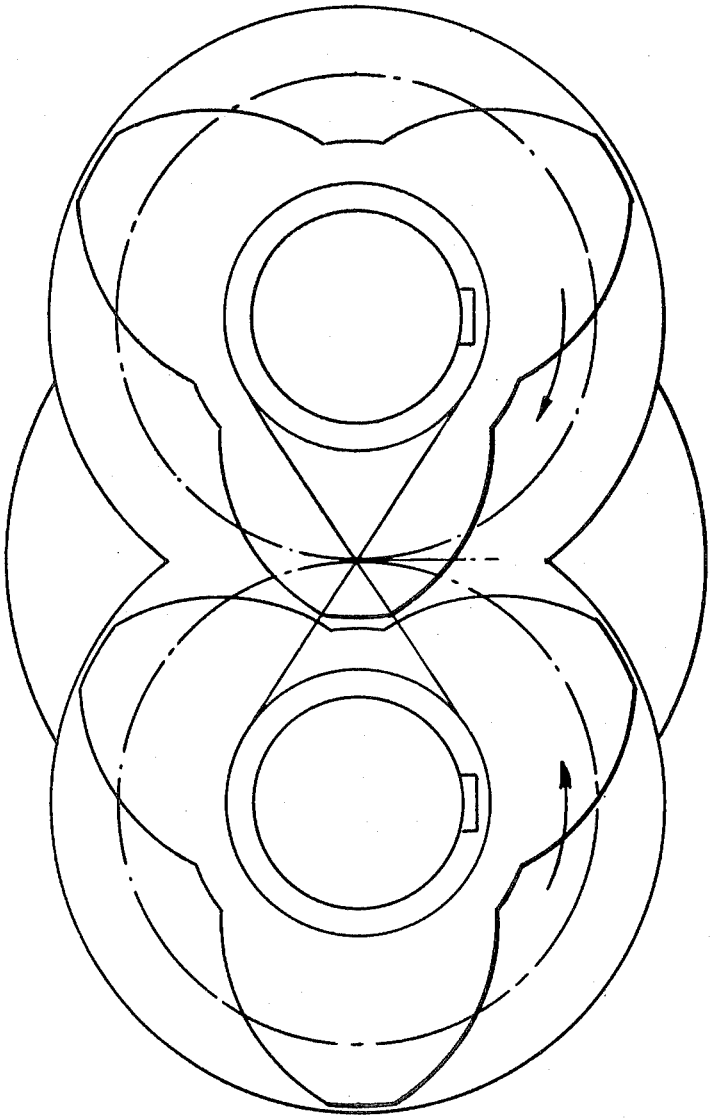
FIG. 2 is an end elevation of the liquid-conveying gears 2 and 3 illustrated in FIG. 1.

In the pump shown in the drawing a casing 1 has disposed in it two liquid-conveying pumping gears 2 and 3, which per se do not permit synchronous movement transmission and which have a contact ratio lower than 1. Note FIG. 2 for an illustration of the liquid-conveying gears 2 and 3. A cover 4 is fastened on the pump casing by means of bolts 5 to provide sealing for the medium which is to be conveyed and which is introduced and expelled through inlet and outlet connections 6 lying one above the other as seen in the drawing. The two liquid conveying pumping gears 2 and 3 are secured on shafts 7 and 8, which pass through seals in an intermediate flange 9. The shafts 7 and 8 are mounted at one end in the intermediate flange 9 and at the other end in a gear casing 10. The two shafts are connected together by gears 11 and 12 secured thereon as auxiliary gearing. The drive input to the gear pump is at end 13 of the shaft 7.

The two gears 11 and 12 are fastened on the shafts 7 and 8 by shrink fitting of cylindrical bores of the gears onto their shafts. To achieve exact rotational adjustment of the gear 12 on the shaft 8, which is necessary in order to bring the two liquid conveying pumping gears 2 and 3 into the correct position relative to one another, pressure oil is supplied by way of a bore 14 in the shaft 8 as a hydraulic force medium into a circumferential annular groove 15, whereby the gear 12 can be expanded and the correct rotational adjustment can easily be made. After the hydraulic force by the oil pressure has been released the gear 12 will contract and remain fixed on the shaft 8 in the desired position of adjustment.

Pressure oil as the hydraulic medium can be supplied to the bore 14 from an external source, such as a hydraulic pump. For this purpose casing 10 carries a removable cover **10*a*, which can be secured on the casing such as by bolts at 10*b*, to provide access to an end of the bore 14. The end of the bore adjacent the cover 10*a* has a screw-threaded socket 8*a*** for receiving a coupling hose or other connection to the external source of hydraulic medium.

What is claimed is:

1. A gear pump comprising a casing, intermeshing pumping gears carried in said casing, said pumping gears having a contact ratio of less than one, and gear transmission means connected to the respective pumping gears for rotating said pumping gears in synchronised relation with each other, said gear transmission means including intermeshed auxiliary gears, a first shaft having one of said auxiliary gears mounted thereon by an interference fit fixing the gear on the shaft by friction, said first shaft also having one of said pumping gears fixed thereon and axially spaced from said one auxiliary gear, a second shaft having the other one of said auxiliary gears fixed thereon, and also having the other said pumping gear secured thereon in axially spaced relation from the other one of said auxiliary gears, bearing means rotatably supporting said shafts in said casing, said bearing means for at least said first shaft comprising axially spaced rotary bearing elements and said one of said auxiliary gears being mounted on said first shafts between said bearing elements, an interface between said one auxiliary gear and said shaft having an annular space extending circumferentially about said shaft for pressure hydraulic fluid, and a passage through said shaft communicating with said space to convey hydraulic fluid under pressure therethrough to said annular space to cause hydraulic expansion of said one auxiliary gear to allow relative angular adjustment between said one auxiliary gear and said first shaft.

2. A gear pump according to claim 1 wherein said shaft supporting said one auxiliary gear has an axial end face and an entry to said passage is provided in said end face, said entry being accessible in the assembled state of the gear pump, an annular groove in said interface between said one auxiliary gear and said shaft providing said space, said passage communicating with said space at its end remote from said face entry.

3. A gear pump according to claim 2 further comprising a screw-threaded socket at the entry to said passage in said shaft end face for the connection of a hydraulic pressure source to the passage.

4. A gear pump according to claim 2 wherein the interface between said one auxiliary gear and said shaft is cylindrical in both axial directions from said annular groove and the interference fit is a transverse interference fit.

* * * * *